US006755205B1

(12) United States Patent
Hoemke et al.

(10) Patent No.: US 6,755,205 B1
(45) Date of Patent: Jun. 29, 2004

(54) METHOD TO STABILIZE A NOZZLE FLAPPER VALVE

(75) Inventors: Brian E. Hoemke, Belvidere, IL (US); Brian K. Lawver, Rockford, IL (US); Daniel J. McLevige, Davis, IL (US)

(73) Assignee: Woodward Governor Company, Rockford, IL (US)

( * ) Notice: Subject to any disclaimer, the term of this patent is extended or adjusted under 35 U.S.C. 154(b) by 45 days.

(21) Appl. No.: 10/242,539

(22) Filed: Sep. 12, 2002

(51) Int. Cl.[7] ..... F15B 13/044
(52) U.S. Cl. ..... 137/82; 137/625.62
(58) Field of Search ..... 137/82, 625.61, 137/625.62

(56) References Cited

U.S. PATENT DOCUMENTS 3,857,541 A * 12/1974 Clark ..... 137/625.62

4,265,272 A * 5/1981 Klimowicz et al. .... 137/625.62

* cited by examiner

*Primary Examiner*—Gerald A. Michalsky
(74) *Attorney, Agent, or Firm*—Leydig, Voit & Mayer

(57) ABSTRACT

A method and apparatus to attenuate a flapper valve from oscillating is presented. An inertia tube is added to the flow path of the flapper valve nozzle, which effectively produces a stabilizing pressure force on the flapper at its natural frequency. The inertia tube has a length to area ratio of greater than approximately 1000 in/in$^2$. The addition of an inertia tube to the nozzle makes the fixed size orifice of the nozzle behave like an orifice having a size that is a function of flow frequency. The inertia tube may be a straight tube, a coiled tube, a thread passage and the like.

19 Claims, 11 Drawing Sheets

METHOD TO STABILIZE A NOZZLE FLAPPER VALVE

FIELD OF THE INVENTION

This invention pertains to nozzle flapper valves, and more particularly, to a method to stabilize nozzle flapper valves from generating a buzz at high frequencies and pressures.

BACKGROUND OF THE INVENTION

Flapper valves are used in a wide range of applications and can be made in a number of configurations. Flapper valves are commonly classified by the number of nozzles (dual nozzle vs. single nozzle) and the number of fluid ports (3-way vs. 4-way). A 3-way device will have three ports: supply pressure, drain pressure, and output pressure. The output pressure is commonly called the "servo pressure" because it is often used to move a servo piston. Likewise, a 4-way device will have four ports: supply pressure, drain pressure, and two servo pressures. In this case the two servo pressures work in push-pull mode, where one goes up and the other goes down, allowing them to be used on opposite sides of a servo piston.

Flapper valves are also called "bleed valves" because one of their key characteristics is a continuous bleed of fluid flow from a high pressure source to a low pressure drain. In its most basic form, a flapper valve consists of at least two flow restrictions, at least one of which is variable, which bleed flow from a high pressure source to a low pressure drain in such a way as to create a variable output (servo) flow/pressure which may be modulated by changing the size of the variable restriction. The variable flow restriction is typically mechanized as a nozzle that is pointed at and almost touches a movable flat surface (the "flapper"), although any number of other schemes is possible. The gap between the nozzle end and the flapper is typically quite small, nominally on the order of 1/10 to 1/20 the nozzle diameter. The variable flow restriction area then in the shape of a thin "curtain" around the end of the nozzle gap. There are numerous mechanisms for changing the size of the variable flow restriction, i.e. ways of moving the flapper. Many of these mechanisms involve a mechanical assembly that moves linearly or about a pivot against a centering spring rate. Typically some means of applying an external force to the flapper assembly is provided, such as a torque motor. A torque motor consists of one or more electrical coils and a magnet and armature assembly with magnetically charged air gaps. When electrical current flows in the coils, the magnetic field in the air gaps is altered in such a way as to apply a torque or force to the flapper assembly and cause it to move. Sometimes there is a feedback spring attached to the flapper, which provides a feedback force from servo position or second stage position. (A second stage valve is used in those applications where the flapper has insufficient flow capacity to directly operate the servo.) Thus a force balance determines the position of the flapper. But the configuration of a flapper valve is normally such that the flow and pressure forces acting upon it by the fluid flow are not balanced. As the flapper moves, the flow and pressure through it change, changing the flow and pressure forces on the flapper. These flow and pressure forces can be such as to promote oscillations and instability of the flapper.

One application where flapper valves are used is high response, multistage servovalves. The first stage of the servovalve is a double acting nozzle flapper valve with a torque-motor actuated flapper and the second stage is a spool valve. The torque-motor is spring centered to null position. At the null position, the flapper is centered between the two nozzles and the nozzle pressure forces are balanced. Each nozzle is fed from a high pressure fluid or pneumatic source through an orifice. When the current through the torque-motor coil is increased from null, the resulting increase in the electromagnetic force causes the flapper to move. The flapper closes one of the nozzles and diverts flow to a spool end. The spool moves and opens one of the control ports to supply and opens the other port to return. A feedback spring provides a feedback force from the second stage position back to the flapper. The spool stops at a position where the feedback spring torque equals the torque due to the coil current (i.e., the input current). This results in the spool position being proportional to input current. In a constant pressure system, the flow to the load is proportional to the input current.

The flapper valve and associated torque motor parts that move with it represent a mass that moves about a pivot against a spring rate. This mass-spring combination has a natural frequency at which it tends to oscillate. The damping on this mass-spring combination is normally quite low. A recurring design problem with flapper valves, particularly high response, multistage servovalves, is avoiding flapper oscillation at the natural frequency. The natural frequency typically ranges from a few hundred up to around a thousand cycles per second. The flapper oscillation, which may generate an audible buzzing sound, is highly undesirable for several reasons. First, it may cause premature failure from metal fatigue from the induced cyclic stress. Second, it may cause performance problems. During oscillation, the steady state output flow and pressure characteristics will shift due to the nonlinear nature of the turbulent flow through restrictions in the flow path. This oscillation is particularly detrimental when the oscillation comes and goes, causing the output pressure and flow to shift or step in value. The oscillation may be self sustaining in extreme cases, or, in milder cases, may manifest itself as a "ringing" or "resonance" in response to external inputs. For example, mechanical vibration at the natural frequency may cause the valve to buzz. It may manifest itself as a "ringing" of the flapper position after a step current input where the flapper will oscillate with decaying amplitude before settling out. Such behavior is undesirable in high response systems. The tendency to oscillate becomes greater with increasing supply pressure. The reason is the higher the supply pressure, the higher the flow and pressure gain of the flapper. As is well known in the art of control theory, raising gains within a system usually has the effect of making it faster, but degrading its stability.

Industry has developed a number of strategies for eliminating or reducing the tendency of flapper valves to buzz. One example is addition of a damping fluid to the torque motor assembly cavity. The flapper and torque motor armature oscillation displaces a highly viscous fluid, which dissipates energy and improves stability. This technique has several disadvantages. One disadvantage is that viscous fluid is temperature sensitive since fluid viscosity varies widely with temperature. Another disadvantage is the technique is not very robust because an operating fluid leak may wash away the damping fluid during the service life of the unit.

Another strategy to improve damping is to add a shorted damping coil to the torque motor. This strategy has the disadvantages of adding expense and taking up space and results in reduced performance of the operating coils. Still another prior art strategy is to add a series flow restriction, normally downstream of the flapper valve. This reduces the flapper valve gain and improves stability, but it also degrades the steady state performance of the system. A further method is to sharpen the edges at the end of the nozzle throat to reduce the lip area that the flowing fluid pressure acts upon. This method has limited effectiveness since it does not affect the area within the nozzle on which the pressure can work. Another prior art method is to reduce the nozzle diameter and increase the nozzle gap, which reduce the pressure and flow gain. While this improves stability, it also degrades steady state performance.

BRIEF SUMMARY OF THE INVENTION

The invention provides a way to stabilize a flapper valve that is very robust, very inexpensive, and that does not degrade the steady state performance of the unit. An inertia tube is added to the flow path of the flapper valve nozzle. The inertia tube has a length to area ratio of greater than 1000 in/in$^2$.

The addition of an inertia tube to the nozzle makes the fixed size orifice of the nozzle behave like an orifice having a size that is a function of flow frequency. The inertia tube may be a straight tube, a coiled tube, a thread passage and the like.

BRIEF DESCRIPTION OF THE DRAWINGS

The accompanying drawings incorporated in and forming a part of the specification illustrate several aspects of the present invention, and together with the description serve to explain the principles of the invention. In the drawings

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
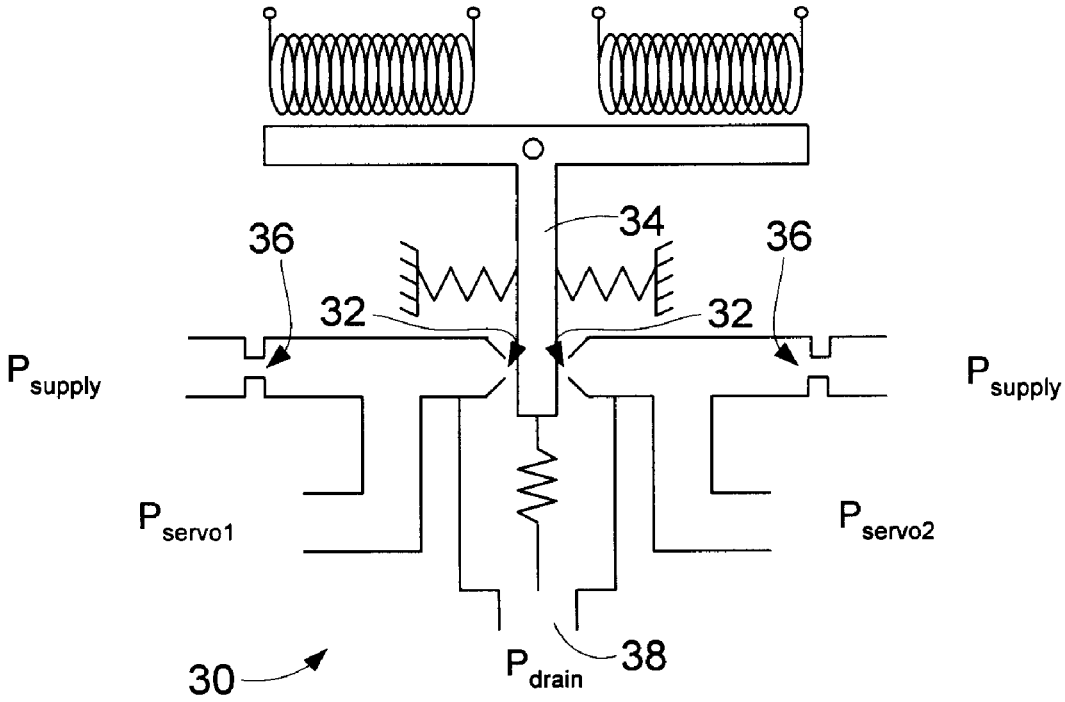
FIG. 1 is an illustration of a 4-way dual nozzle flapper valve in which the present invention may reside.

The present invention provides a method and apparatus to stabilize a nozzle flapper valve from oscillating. A means of modifying flow and pressure forces such that they become a stabilizing rather than destabilizing effect is provided as will be described in more below. Turning to the drawings, wherein like reference numerals refer to like elements, the invention works in a variety of flapper valve configurations. One configuration is illustrated in FIG. 1, which represents a 4-way dual nozzle flapper valve 30. This type of flapper valve is the type most often used in high performance two stage electrohydraulic servovalves. There are two nozzles 32, one on each side of the flapper 34, so that when one opens, the other closes. Each nozzle acts like a variable flow restrictor. The flapper 34 varies flow through the nozzle as it moves in relation to the nozzle and behaves like an effector. Each of the two flapper gaps is fed by flow, coming through a fixed restriction 36, from the high pressure supply. The region downstream of the flapper is open to the low pressure drain 38. When fluid flows from a high pressure supply to a low pressure drain through two restrictions in series, the pressure between the two restrictions will be intermediate between the supply and drain pressures. When the area of the variable flow restriction is changed by movement of the flapper 34, the value of the intermediate (servo) pressure will also change. The nature of change will depend on to what the servo pressure ports are connected. For purposes of understanding, two extremes can be considered. First, if the two servo ports are deadheaded, there can be no servo flow, and only servo pressure is generated. This is called the "pressure gain" mode, where the servo pressure is a function of the current in the coils. In this case, the servo pressure is taken as the differential pressure between the two servo ports. Second, the two servo ports are connected together through a frictionless, unloaded servo piston, which is effectively the same as just shorting the servo ports together through a connecting pipe. In this case there is no pressure differential between the two servo ports, only servo flow. This is called the "flow gain" mode, where servo flow is a function of current in the coil. (See FIG. 4). In actual operation, the flapper valve servo pressure and flow would both be changing, so it would not be operating in either pure pressure gain mode or pure flow gain mode.

Figure 2:
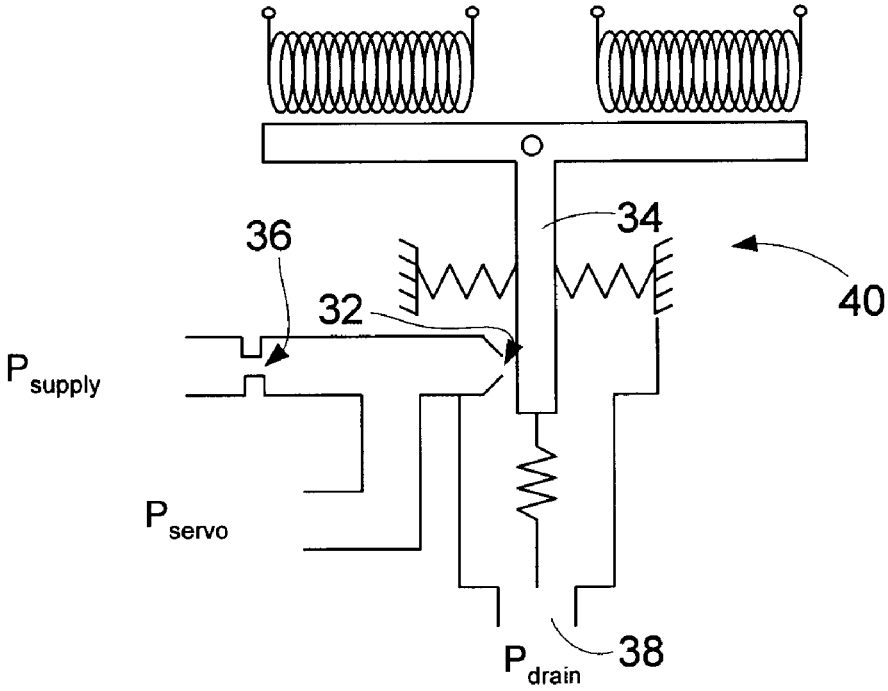
FIG. 2 is an illustration of a 3-way single nozzle flapper valve in which the present invention may reside.
Figure 3:
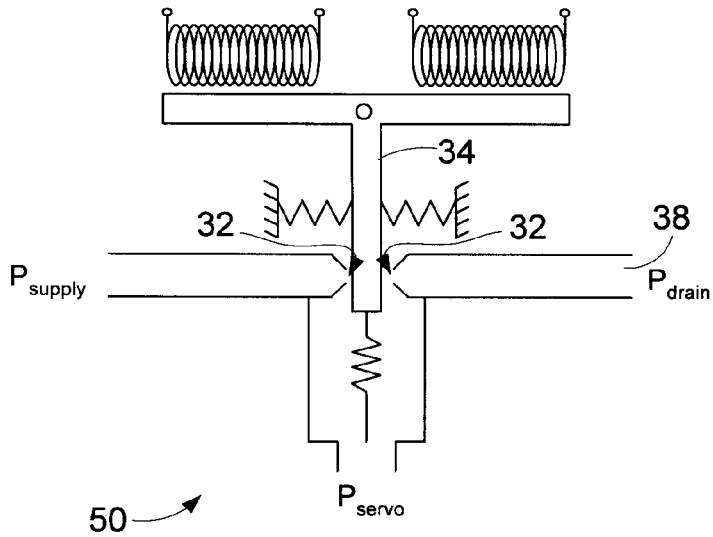
FIG. 3 is an illustration of a 3-way dual nozzle flapper valve in which the present invention may reside.

FIG. 2 represents a 3-way single nozzle flapper 40 in which the present invention may operate. The 3-way single nozzle flapper 40 is similar to the 4-way dual nozzle flapper valve 30. Only one nozzle is present along with its associated servo pressure and supply orifice. FIG. 3 represents a 3-way dual nozzle flapper valve 50. It is different from FIGS. 1 and 2 in that it has no fixed flow restrictions. Instead, it has two variable flow restrictions in series. Fluid flows from high pressure supply through one variable nozzle gap into the intermediate servo pressure cavity, then out through the other variable nozzle gap to low pressure drain. As the flapper moves, it opens one gap and closes the other gap, modulating the servo pressure and flow. Additional variations of the configurations shown in FIGS. 1 to 3 are possible. For example, the flow direction could be reversed by interchanging the supply and drain pressures. Also, additional fixed restrictions could be introduced, either in the servo flow line(s), supply flow line, or drain flow line.

The characteristics of fluid compressibility and fluid inertia will be reviewed in order to better understand the invention because these characteristics are involved in both the flapper instability problem and in the solution presented by the invention. All fluids have some compressibility, even liquids such as jet fuel or hydraulic fluid used in high performance servovalves. When pressure rises, the fluid compresses and reduces in volume. This volume reduction with time as the pressure increases can be thought of as "compressibility flow." Referring now to FIG. 5, the compressible volume 200 can be thought of as a balloon that expands and contracts as the pressure changes, with compressibility flow going in or out of the balloon. It can be seen that compressibility flow only exists while the pressure is changing. The faster the pressure changes, the more the compressibility flow. If the pressure is changing as a sine wave, it can be seen from FIG. 6 that the compressibility flow will also be a sine wave, except displaced one quarter cycle in time, or 90 degrees in phase.

Figure 7:
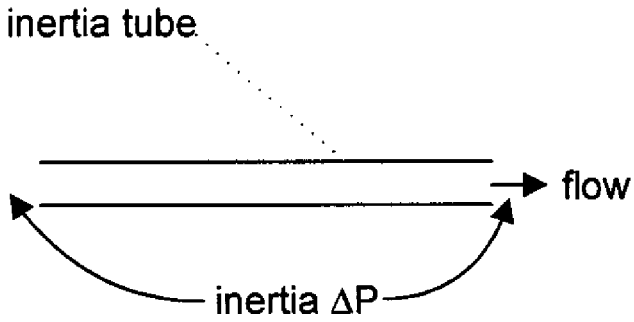
FIG. 7 illustrates pressure vs. flow in an inertia tube.
Figure 8:
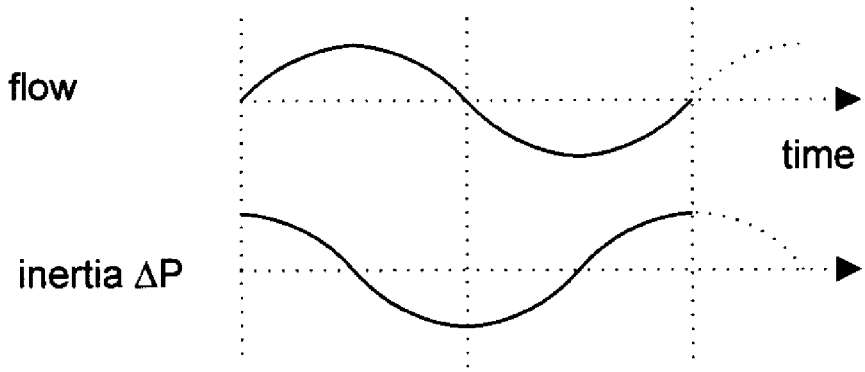
FIG. 8 is graphical illustration showing the effect of pressure vs. flow in an inertia tube as a function of time.

Fluid flowing in a passage has inertia because all fluids also have mass. If the flow rate is changing, the fluid mass is being accelerated. A force is always required to accelerate a mass. In the case of fluid, the force manifests itself as a pressure drop. Thus if the flow in a passage is changing, a pressure drop due to inertia will occur in the passage. The inertia $\Delta P$ only exists when the flow is changing, and the faster the flow changes, the more the inertia $\Delta P$. It can be seen from FIGS. 7 and 8 that if the flow is a sine wave, the inertia $\Delta P$ will also be a sine wave except displaced one quarter cycle in time, or 90 degrees phase. It can be seen that the flow vs. pressure relationship for compressibility and inertia are inverse. For compressibility, pressure lags the flow, while for inertia, pressure leads the flow.

Figure 9:
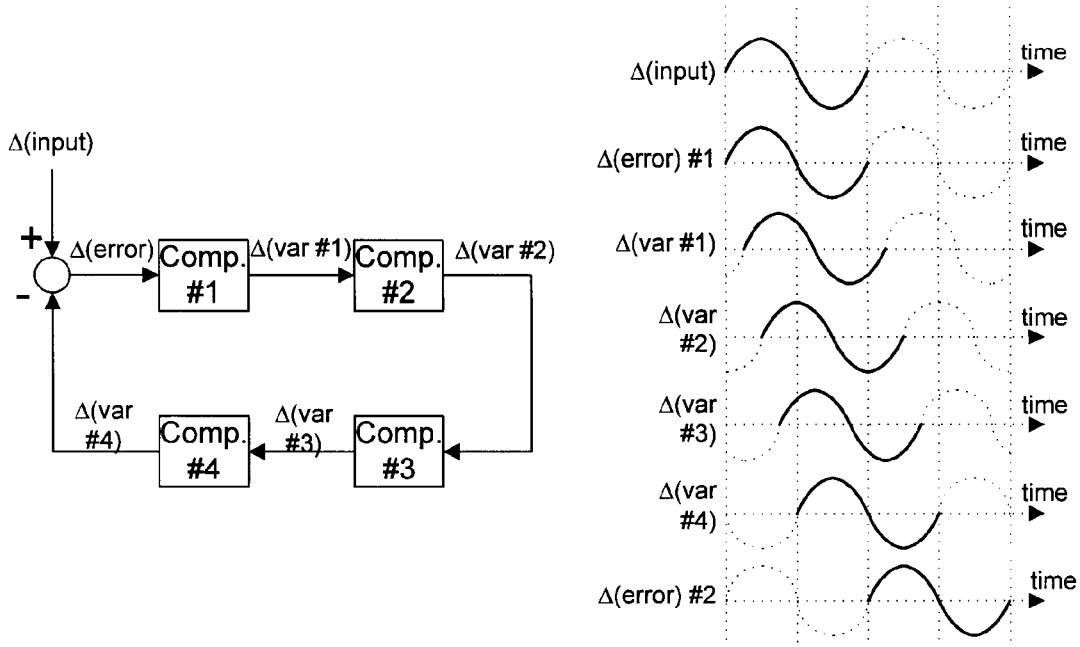
FIG. 9 illustrates disturbance propagation around an unstable feedback loop.

Turning now to FIG. 9, the phase and gain relationships in an unstable system will be briefly reviewed to enable better understanding of the invention. In many unstable systems, a feedback loop is involved. Any disturbance that propagates around the loop will die out if the loop is stable. If the loop is unstable, the disturbance will continue going around the loop without dying out, which means the loop oscillates continuously. For example, in an unstable loop with a loop gain of one, a comparison of the disturbance the first time it hits the $\Delta$(error) point with the second time it hits that point after going around the loop shows that the disturbance amplitude is still the same, but it has been shifted exactly one whole cycle in time. After going around the loop, the disturbance looks exactly like the original disturbance and it is ready to go around the loop again. The disturbance will continually go around the loop. In control theory terminology, the loop gain is one and the loop phase is a negative 180 degrees (by convention the minus sign is not included). One method of stabilizing the loop is to lower the loop gain, so that the disturbance diminishes in amplitude each time it goes around the loop, eventually dying out. However, in many loops, including flapper valves, the options for reducing the gain for stability are limited, because the low frequency (steady state) gain cannot be lowered without degrading the steady state performance of the system. The invention provides a way of reducing the loop gain to stabilize the flapper valve without affecting the steady state performance.

Figure 10:
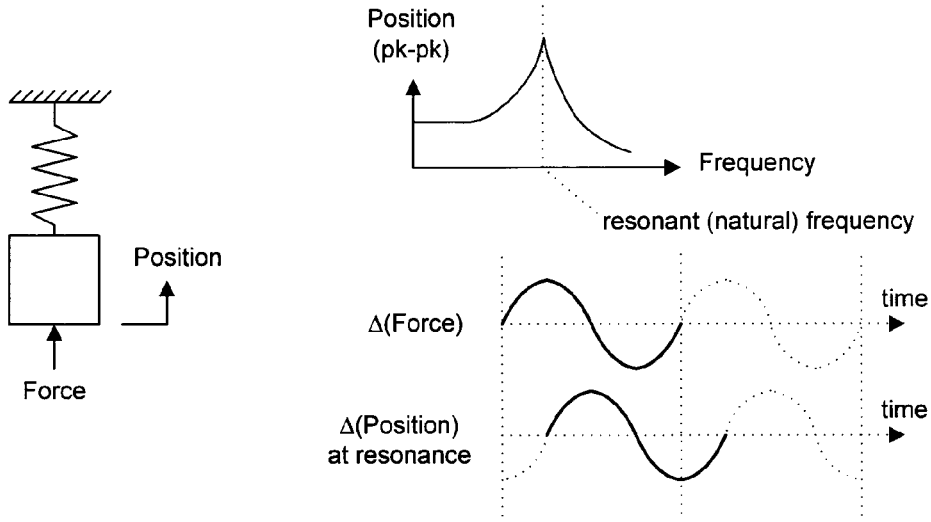
FIG. 10 illustrates mass-spring behavior at the resonant frequency of the mass-spring.

Turning now to FIG. 10, the flapper valve can be modeled as a mass-spring system. As illustrated in FIG. 10, a mass is suspended on a spring, subjected to an external force. If the force is oscillated through a range of frequencies, a frequency where the movement of the mass will be greatly amplified will be found. This frequency is referred to as the resonant frequency or natural frequency. If the force is a sine wave at the natural frequency, the position sine wave will be amplified but will lag one quarter cycle in time (i.e., 90 degrees phase).

Although not required, the invention will be described in the general context of an electrohydraulic servovalve. For purposes of illustration, a liquid fluid pressure source will be used to describe the invention. The invention may also be practiced in other environments where flapper valves are used and in applications where the source medium is compressible. For example, a fuel source, a hydraulic oil source, or a pneumatic source can be used. The invention may be used in other applications where decoupling of fluid or pneumatic compressibility and pressure forcing functions is required. The invention is illustrated as being implemented in a suitable electrohydraulic servovalve 100.

Figure 11:
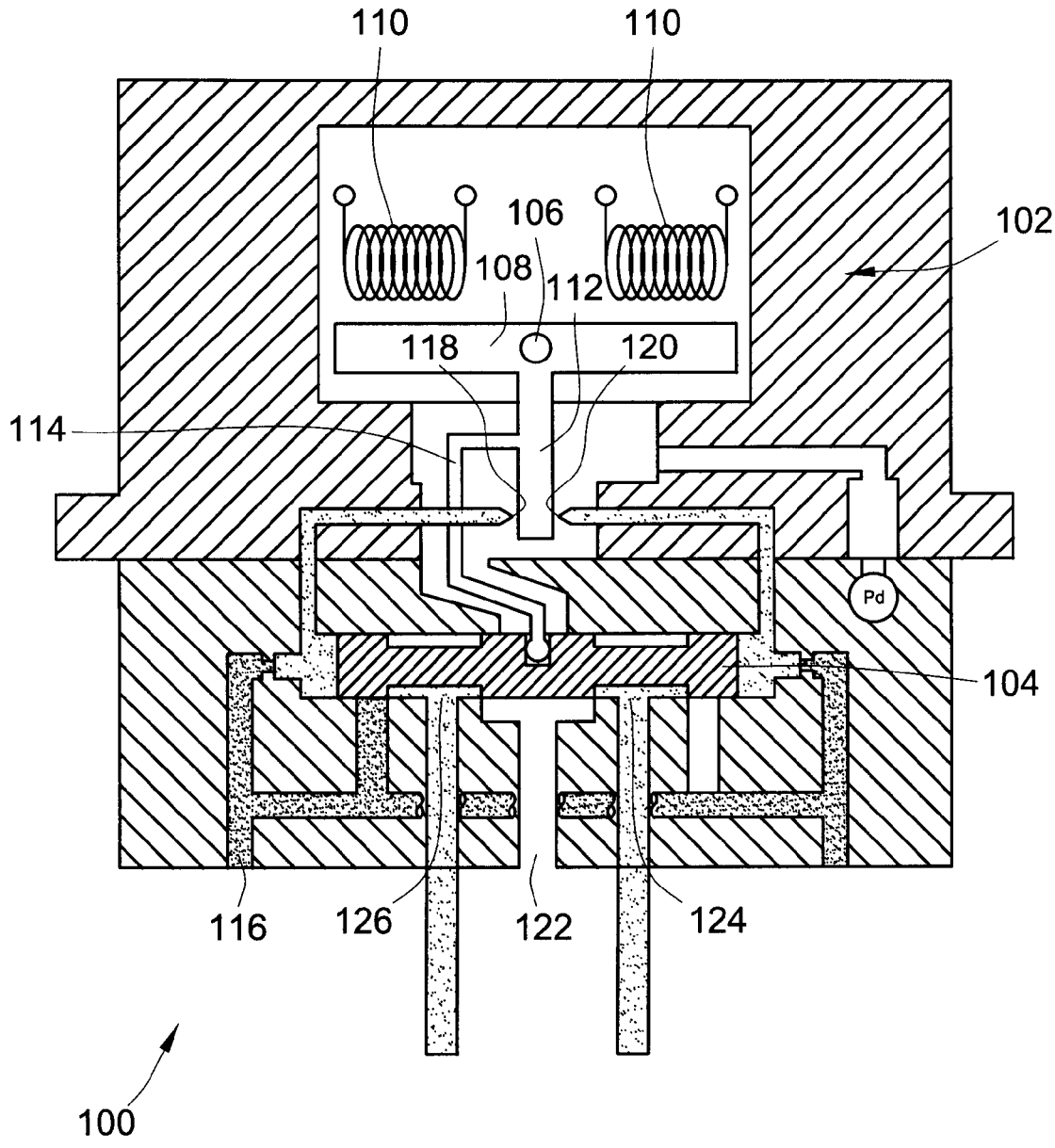
FIG. 11 is a schematic view of a flapper valve installed as a first stage of an electrohydraulic servovalve at a null position.

With reference to FIG. 11, the electrohydraulic servovalve 100 comprises a torque motor and flapper valve assembly 102 and second stage spool valve 104. The torque motor/flapper valve assembly 102 has a torque motor 106 that is used to rotate the armature assembly 108 when input current is increased in the coils 110. Flapper 112 is connected to the armature assembly 108 and feedback spring 114 is connected to flapper 112. The end of the feedback spring 114 is inserted into the spool valve 104. At the null position, the fluid flows from the source 116 through nozzles 118, 120 to return (e.g., drain) 122. At null position, the pressure in nozzle 118 is approximately equal to the fluid pressure in nozzle 120.

Figure 12:
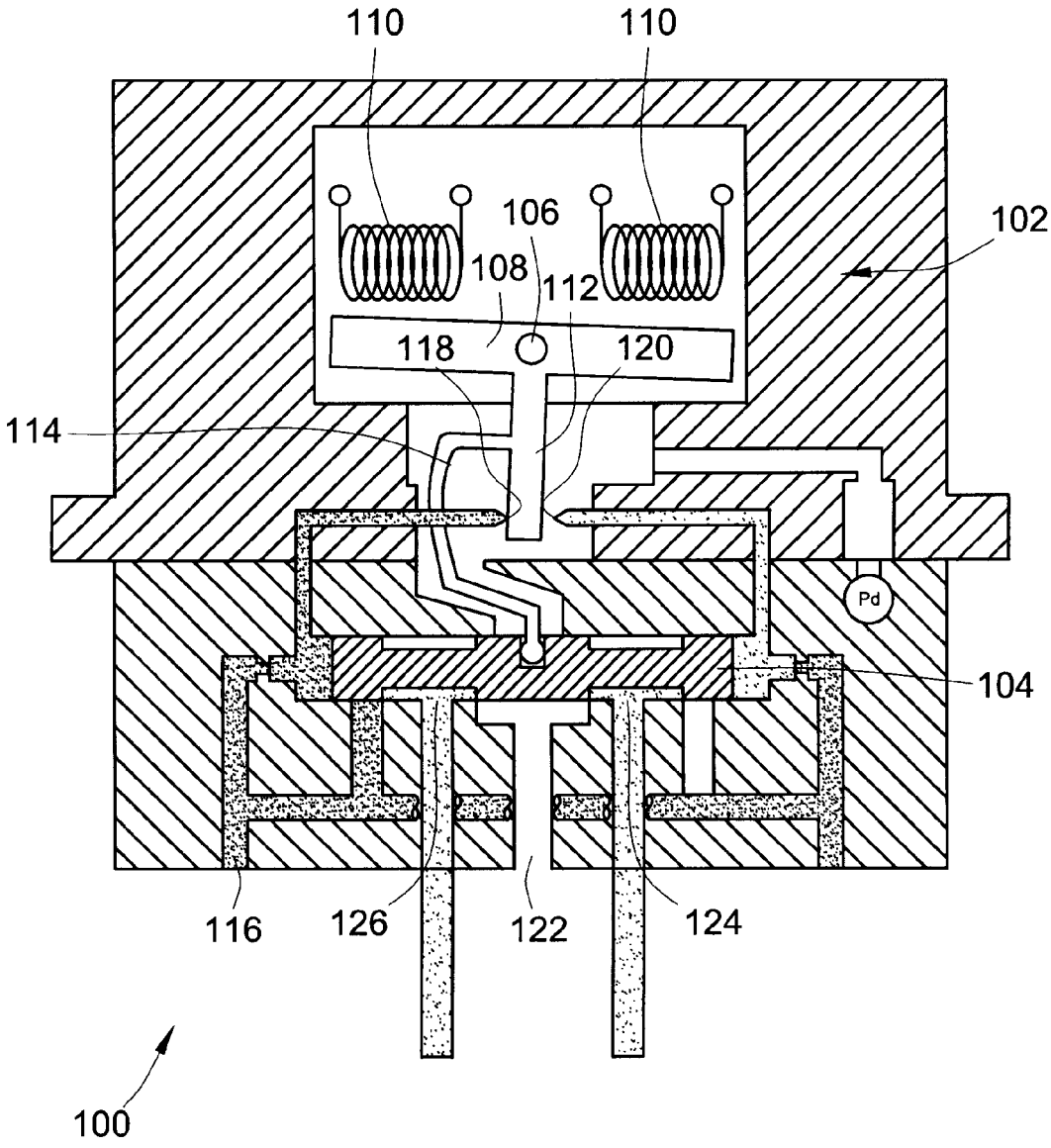
FIG. 12 is a schematic view of the servovalve of FIG. 11 with the first stage off of null and the second stage at null but about to move.
Figure 13:
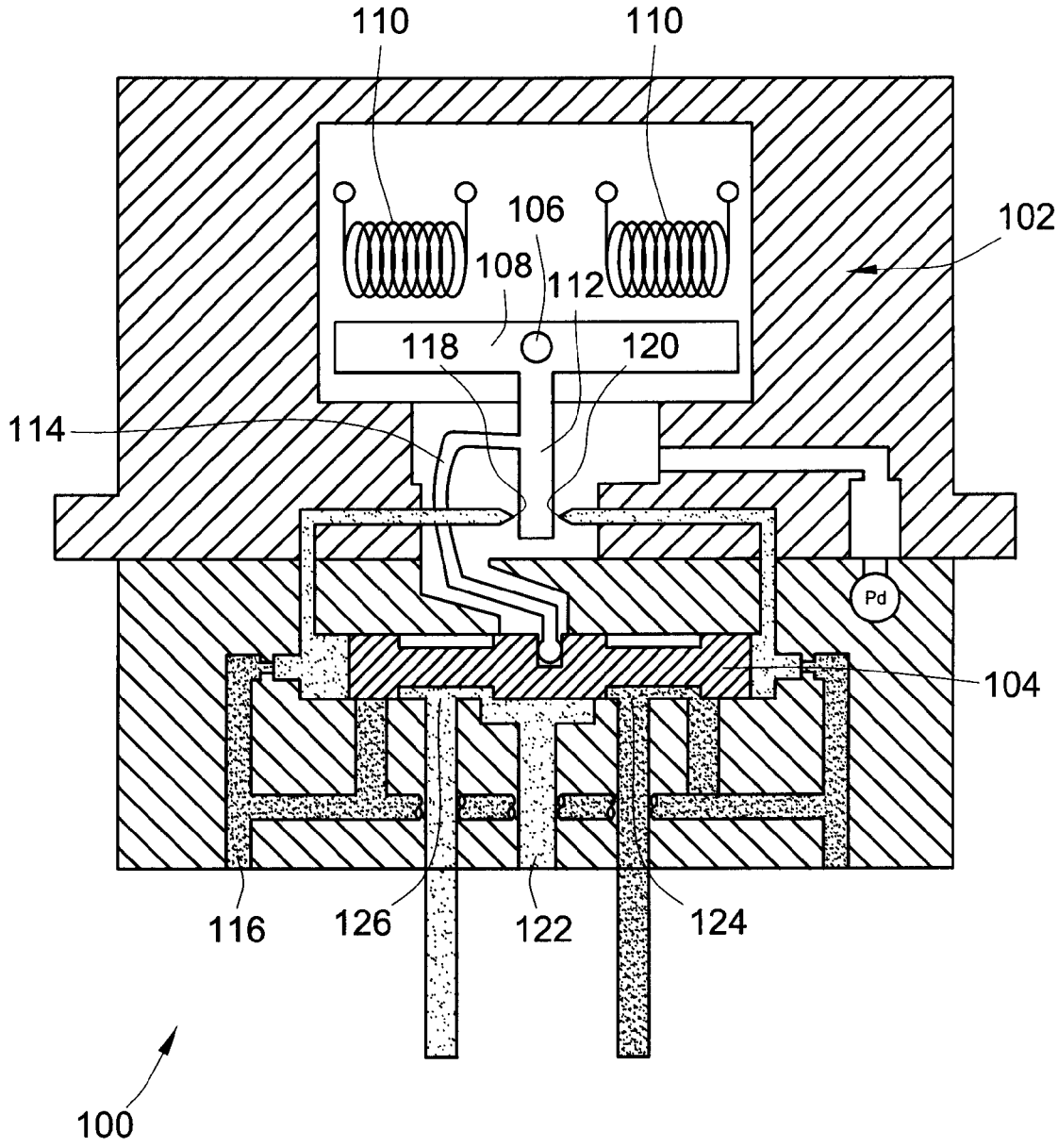
FIG. 13 is a schematic view of the servovalve of FIG. 11 at a steady state off null position with the first stage at null position and the second stage at a flow position.

During normal operation, an increase in the input current produces an electromagnetic force that causes the armature assembly 108, flapper 112 and feedback spring 114 to move. The flapper 112 closes one of the nozzles (e.g., 118), which results in the pressure in the closed nozzle increasing to the source pressure and the pressure in the open nozzle (e.g., 120) decreasing to the return pressure (see FIG. 12). The resultant pressure differential across spool valve causes it to move, moving the feedback spring, until the feedback spring force is sufficient to renull the flapper, eliminate the differential pressure, and stop the spool valve movement (see FIG. 13). The feedback spring causes the spool valve position to be proportional to input current, where the torque generated by the input current exactly balances the torque generated by the feedback spring.

Figure 4:
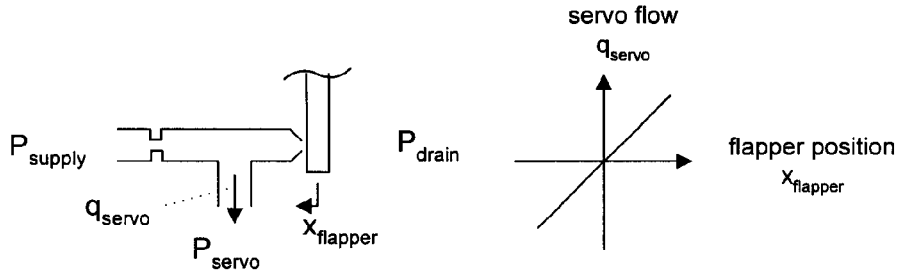
FIG. 4 illustrates the flow gain mode of a flapper valve.
Figure 5:
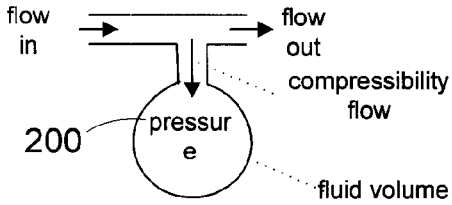
FIG. 5 illustrates flow vs. pressure in a compressible fluid volume.
Figure 6:
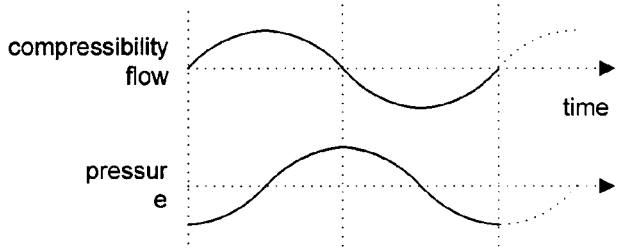
FIG. 6 is a graphical illustration showing the effect of flow vs. pressure in a compressible fluid volume as a function of time.

Before explaining how the invention works, an explanation of the cause of the most common type of flapper valve instability will be discussed. For purposes of this discussion, a 3-way single nozzle flapper will be illustrated. It is understood that the invention can be applied to any of the various other types of flapper valves. This type of flapper valve instability occurs at or near the mechanical natural frequency of the torque motor armature and flapper valve assembly. The motor armature and flapper valve assembly can be modeled as a mass-spring assembly. This mass-spring assembly normally has rotary motion about a pivot, rather than linear motion, but the concept is the same. The flapper valve instability normally occurs at a high enough frequency that fluid compressibility effects in the servo pressure volume becomes an important factor. Referring to FIG. 5, the servo pressure compressible volume 200 acts like an accumulator, tending to minimize the magnitude of servo pressure oscillations. The flapper valve can be thought of as working approximately in "flow gain" mode because the servo pressure change is not too large. This means that as the. flapper moves, it generates flow proportional to flapper movement, as shown in FIG. 4.

Figure 14:
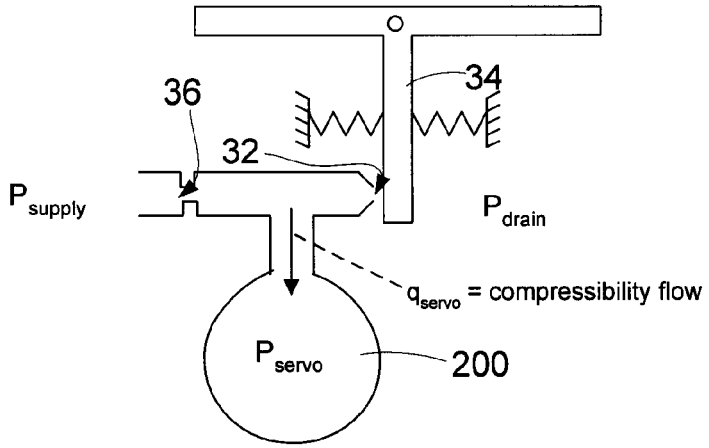
FIG. 14 is an illustration of compressibility flow in the flapper valve of FIG. 2.
Figure 15:
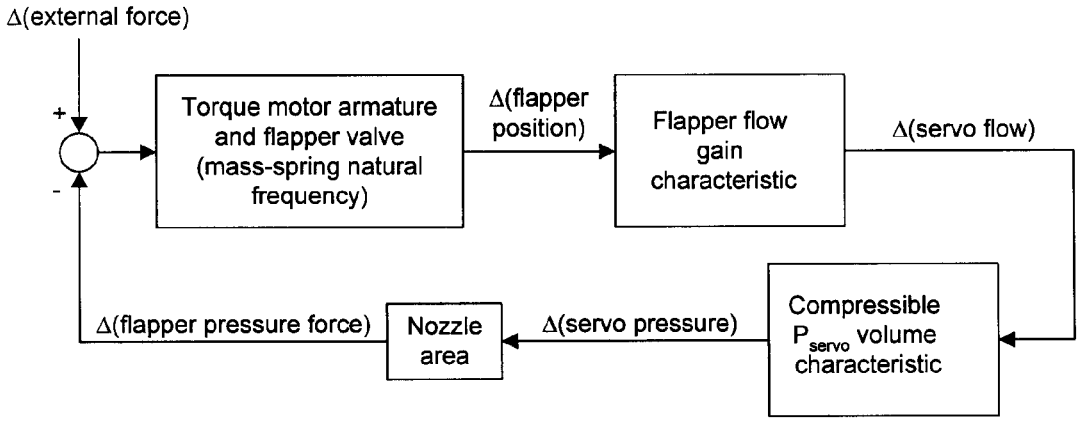
FIG. 15 is a block diagram of the feedback loop of the flapper valve of FIG. 14.
Figure 16:
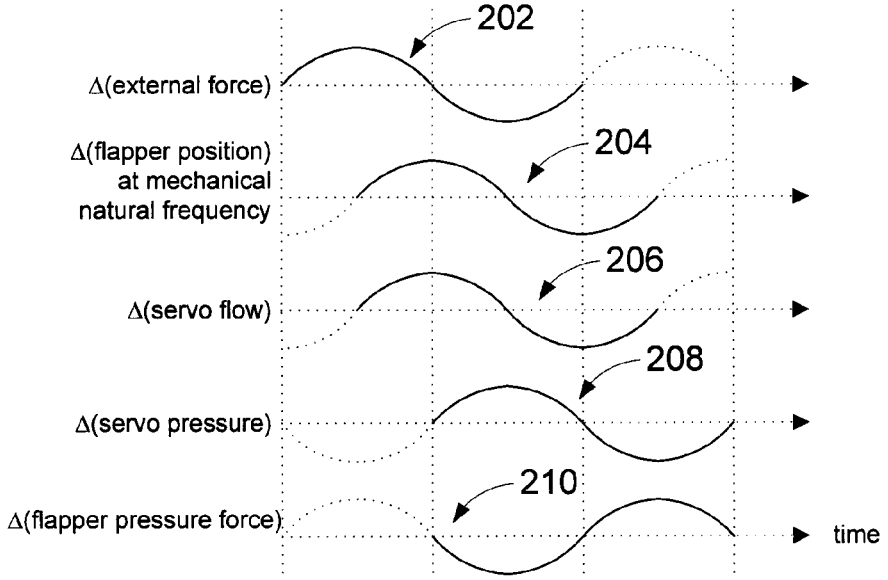
FIG. 16 is a graphical illustration of flapper valve instability in the flapper valve of FIG. 14.

Turning now to FIGS. 14–16, the unstable feedback loop which underlies this form of flapper valve instability shall now be explained. If an external force disturbance at the armature/flapper natural frequency, indicated by the single sine wave 202, is introduced into the system, the flapper position 204 will lag the disturbance by 90 degrees because we are exciting a mass-spring assembly at its resonant frequency. Because the flapper is working in approximately flow gain mode, the flapper position disturbance will generate an in-phase servo flow disturbance 206. The servo flow disturbance 206 feeds into the compressible fluid volume, thereby generating a pressure disturbance 208 that lags flow by 90 degrees. This pressure disturbance acts on the nozzle area on the flapper, generating a force disturbance 210 on the flapper. This force disturbance acts in the opposite direction as the original external force, as represented by the minus sign (i.e., a 180 degrees phase lag) in FIG. 15. If the loop is unstable, the pressure disturbance force will be exactly equal in amplitude but displaced one cycle in time, from the original external disturbance force. The loop can be stabilized by lowering the gain. For example, the gain may be lowered by stiffening the torque motor mechanical spring rate, reducing the nozzle diameter, increasing the nozzle gap, or adding a series flow restriction. However, these and other conventional fixes have the major disadvantage of degrading the steady state (i.e., low frequency) performance. The present invention provides a way of reducing the loop gain to stabilize the flapper valve without affecting the steady state performance.

Figure 17:
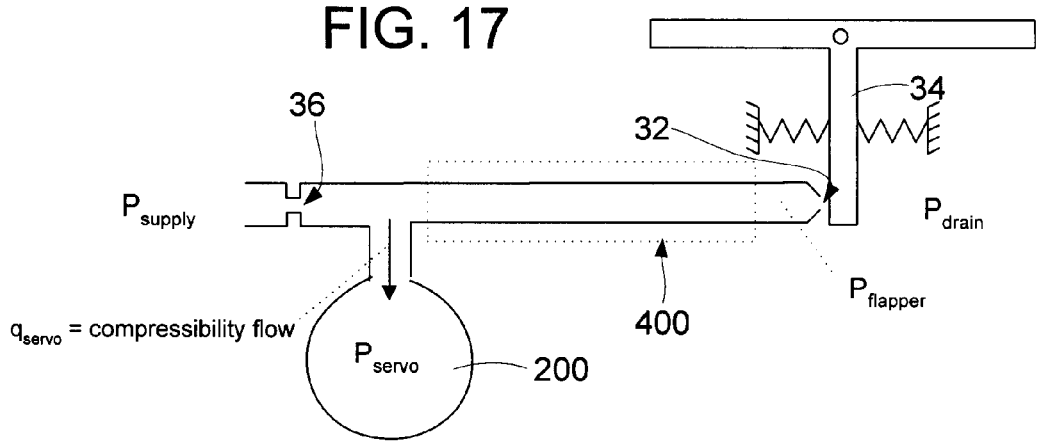
FIG. 17 is an illustration of the effect of compressibility flow in the flapper valve of FIG. 2 having an inertia tube in accordance with the present invention.
Figure 18:
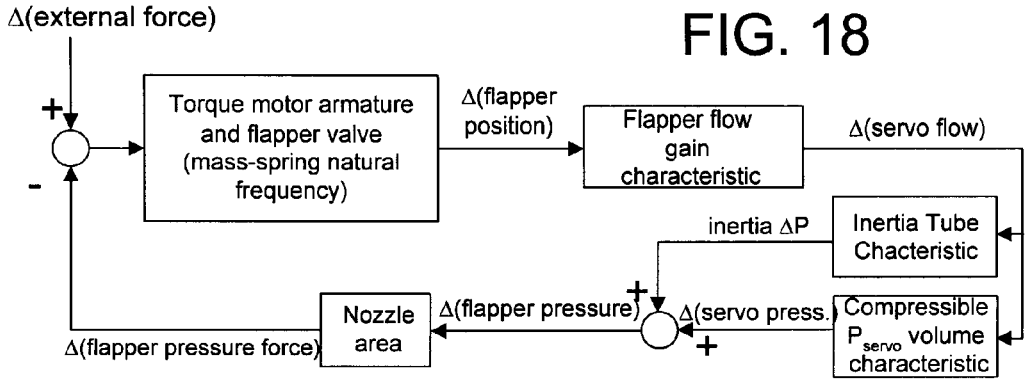
FIG. 18 is a block diagram of the feedback loop of the flapper valve of FIG. 17.
Figure 19:
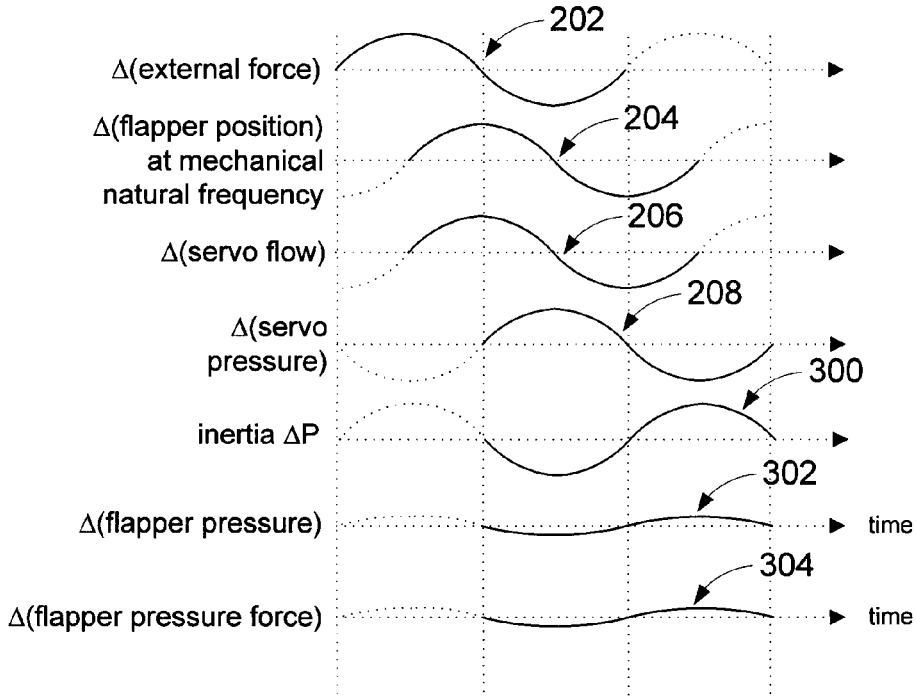
FIG. 19 is a graphical illustration of the stabilizing effect of the inertia tube in the flapper valve of FIG. 17.

Turning now to FIGS. 17–18, the present invention adds a long, thin fluid passage (e.g., an inertia tube) in the fluid path of the flapper valve nozzles that cancels the effect of already present compressibility, stabilizing the system. The inertia tube is not limited to a long, thin fluid passage. It may be implemented in a variety of ways. By way of example and not limitation, the inertia tube can be a long thin tube, a long coiled tube, thread passages and the like (see FIGS. 21*a*–21*c*). In one embodiment, the inertia tube is integral to the flapper valve nozzle 32. The inertia tube adds inertia that cancels the effect of already present compressibility and stabilizes the system. For purposes of this discussion a 3-way single nozzle flapper will be illustrated, but it is understood that the invention can be applied to any of the various other types of flapper valves. Referring to FIGS. 17–19, a long, thin fluid passage, or inertia tube, has been added between the nozzle and the servo pressure compressible volume. While this location of the inertia tube is shown for illustration purposes, it is to be understood that other locations in the valve flow stream are also possible (e.g., downstream of the flapper in the drain pressure line). Now the pressure in the servo compressible volume and the pressure acting on the flapper are separated and differ by the inertia ΔP across the inertia tube. To illustrate the effect on stability, a single sine wave external force disturbance 202 at the torque motor natural frequency is introduced and illustrated in FIGS. 18 and 19. This results in a flapper position disturbance 204 lagging by 90 degrees. This then gives a servo flow disturbance 206 in phase with the flapper. The servo flow disturbance generates a servo pressure disturbance 208 lagging flow by 90 degrees. This servo pressure disturbance 208 is not seen directly by the flapper, because of the presence of the inertia tube. The flow disturbance also generates an inertia ΔP disturbance 300 leading flow by 90 degrees. The servo pressure disturbance and the inertia ΔP disturbance add together to form the flapper pressure disturbance 302. The pressure disturbances differ in phase by 180 degrees, so they subtract. The net flapper pressure disturbance is thus much reduced, greatly reducing the resultant flapper pressure force 304. This introduces a major loop gain reduction and it results in stabilizing the system. A major advantage of the inertia tube is that the gain reduction only occurs at high frequency, where the torque motor natural frequency is located, so it does not degrade steady state or low frequency performance.

Figure 20:
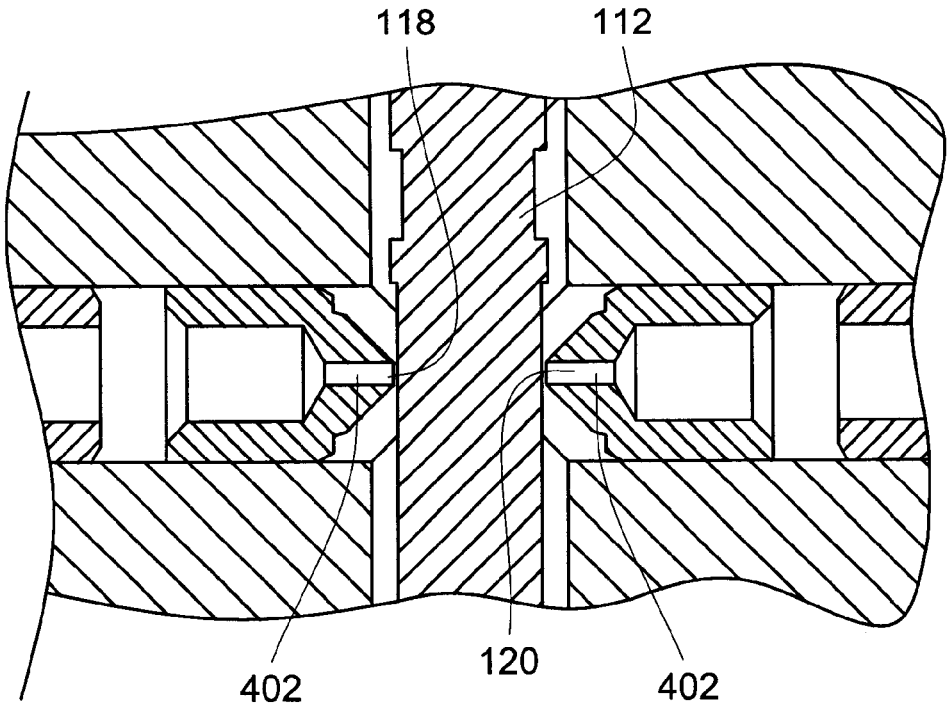
FIG. 20 is a cross-sectional view of a short nozzle.
Figure 21A:
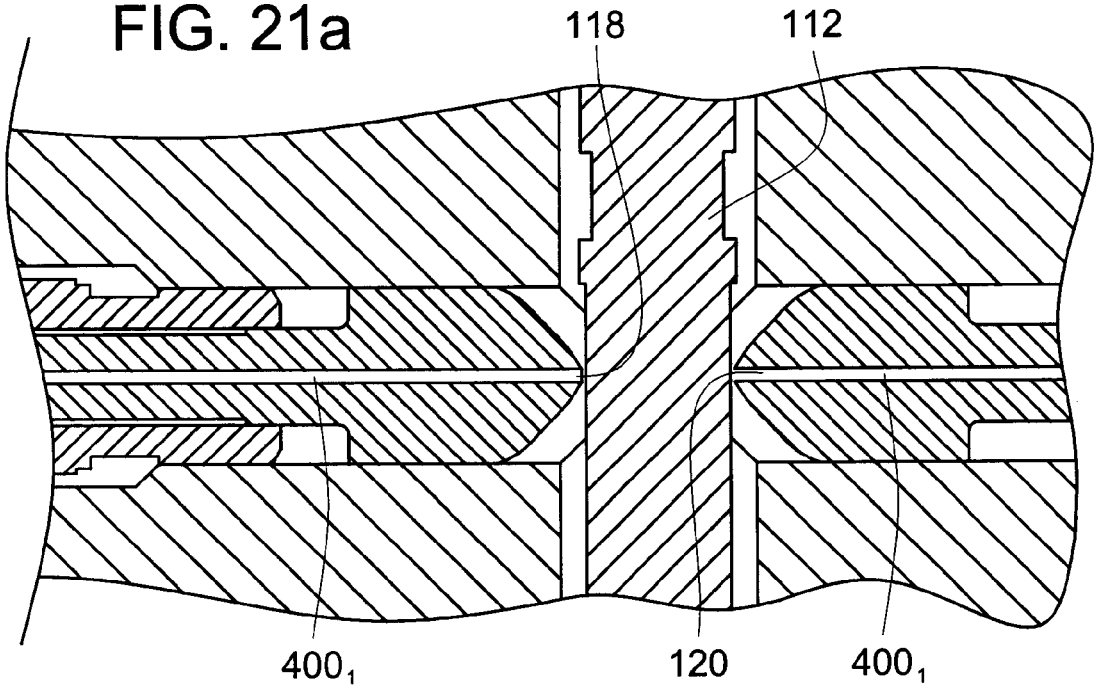
FIG. 21*a* is a cross-sectional view of a long thin inertia tube nozzle in accordance with the present inventions.

Turning now to FIG. 20, a cross-sectional view of a typical short nozzle portion 402 of a flapper valve that oscillates at high pressures is shown. FIG. 21*a* illustrates a cross-sectional view of a flapper valve having an inertia tube integral with the nozzle. The L/A ratio of the short nozzle path is 450 in/in$^2$. The inertia tube $\mathbf{400}_1$ has a L/A ratio that is greater than approximately 1000 in/in$^2$ compared to a typical L/A ratio of less than approximately 350 in/in$^2$ for the short nozzle 402.

Figure 21B:
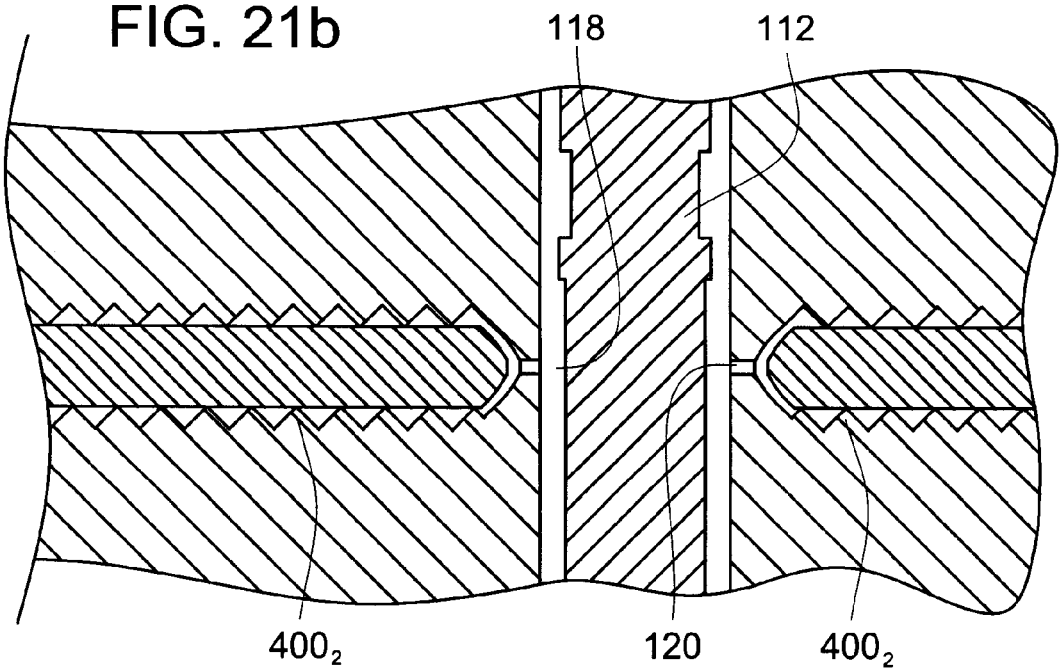
FIG. 21*b* is a cross-sectional view of an inertia tube nozzle having a threaded passage in accordance with the present invention.
Figure 21C:
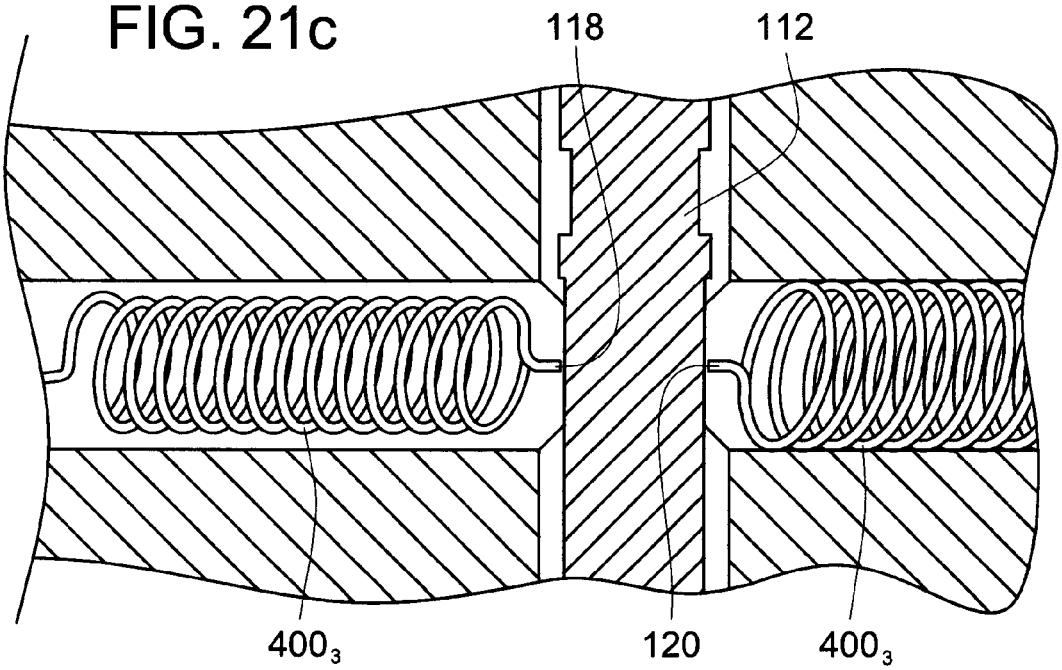
FIG. 21*c* is a cross-sectional view of a coiled inertia tube nozzle in accordance with the present invention.

As previously indicated, the inertia tube can be a long thin tube, a long coiled tube, thread passages and the like. FIG. 21*a* illustrates a long thin tube $\mathbf{400}_1$. FIG. 21*b* illustrates a threaded passage $\mathbf{400}_2$. FIG. 21*a* illustrates a long coiled tube $\mathbf{400}_3$.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. For example, the invention can be implemented on a single acting flapper valve. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context:

What is claimed is:

1. A method of stabilizing a flapper valve having at least one of a liquid and gas flowing between a high pressure source and a low pressure drain, the flapper valve having at least one variable flow restrictor for modulating at least one of an intermediate output flow and an intermediate pressure, the at least one variable flow restrictor in series with at least one flow restrictor, an effector means for varying flow through the variable flow restrictor, the effector means influenced by a force from at least one of an output flow and an output pressure, the effector means prone to oscillate at least one frequency range, the method comprising the step of:

adding at least one flow passage in series with the at least one variable flow restrictor and the at least one flow restrictor, the at least one flow passage being sufficiently long and narrow that the dynamic behavior of the at least one flow passage is dominated by fluid inertia in the at least one frequency range.

2. The method of claim 1 wherein the step of adding the at least one flow passage comprises adding at least one flow passage proximate to the at least one variable flow restrictor.

3. The method of claim 1 further comprising the step of sizing a length to area ratio of the at least one flow passage such that the length to area ratio is greater than 1000 in/in$^2$.

4. The method of claim 1 wherein the step of adding the at least one flow passage comprises adding at least one flow passage integral to the at least one variable flow restrictor.

5. A flapper valve having at least one of a liquid and gas flowing between a high pressure source and a low pressure drain, the flapper valve comprising:

at least one variable flow restrictor for modulating at least one of an intermediate output flow and an intermediate pressure, the at least one variable flow restrictor in series with at least one flow restrictor;

an effector means in communication with the at least one variable flow restrictor for varying flow through the variable flow restrictor, the effector means influenced by a force from at least one of an output flow and an output pressure, the effector means prone to oscillate at at least one frequency range; and at least one flow passage in series with the at least one variable flow restrictor and the at least one flow restrictor, the at least one flow passage being sufficiently long and narrow such that the dynamic behavior of the at least one flow passage is dominated by fluid inertia in the at least one frequency range.

6. The flapper valve of claim 5 wherein the at least one flow passage is integral to the at least one variable flow restrictor.

7. The flapper valve of claim 5 wherein the at least one flow passage has a length to area ratio of at least approximately 1000 in/in$^2$.

8. The flapper valve of claim 5 wherein the at least one variable flow restrictor has an orifice located on an axis and wherein the at least one flow passage is located in the axis.

9. The flapper valve of claim 5 wherein the at least one flow passage is coiled.

10. The flapper valve of claim 5 wherein the at least one flow passage comprises a thread passage.

11. The flapper valve of claim 5 further comprising a feedback spring connected to the effector means.

12. A flapper valve comprising:

a torque motor having an input coil and an armature assembly;

a flapper connected to the armature assembly;

at least one nozzle in fluid communication with the flapper, the at least one nozzle having a flow path; and at least one flow passage in series with the at least one nozzle, the at least one flow passage sufficiently long and narrow such that the dynamic behavior of the at least one flow passage is dominated by fluid inertia in at least one frequency range in which the flapper is prone to oscillation.

13. The flapper valve of claim 12 wherein the at least one flow passage is integral to the at least one nozzle.

14. The flapper valve of claim 12 wherein the at least one flow passage has a length to area ratio of at least approximately 1000 in/in$^2$.

15. The flapper valve of claim 12 wherein the at least one flow passage comprises one of a coiled passage, a thread passage, and a straight passage.

16. A method to attenuate a flapper valve oscillation comprising the step of adding at least one flow passage to a flow path of the flapper valve, wherein the at least one flow passage is sufficiently long and narrow such that the dynamic behavior of the at least one flow passage is dominated by fluid inertia in a frequency range that the flapper valve oscillates.

17. The method of claim 16 further comprising the step of sizing a length to area ratio of the at least one flow passage such that the length to area ratio is greater than approximately 1000 in/in$^2$.

18. The method of claim 16 wherein the step of adding the at least one flow passage comprises the step of adding the at least one flow passage proximate to at least one nozzle of the flapper valve.

19. The method of claim 16 wherein the step of adding the at least one flow passage comprises the step of adding the at least one flow passage integral to at least one nozzle of the flapper valve.

* * * * *

UNITED STATES PATENT AND TRADEMARK OFFICE

CERTIFICATE OF CORRECTION

PATENT NO. : 6,755,205 B1
DATED : June 29, 2004
INVENTOR(S) : Brian E. Hoemke et al.

It is certified that error appears in the above-identified patent and that said Letters Patent is hereby corrected as shown below:

Column 9,
Line 21, change “oscillate at least” to -- oscillate at at least --.

Signed and Sealed this

Twenty-fourth Day of August, 2004

JON W. DUDAS
*Director of the United States Patent and Trademark Office*